US005529393A

United States Patent [19]

Polett

[11] Patent Number: 5,529,393

[45] Date of Patent: Jun. 25, 1996

[54] FLEXIBLE BULK CONTAINER WITH DISPOSABLE LINER

[76] Inventor: Walter J. Polett, P.O. Box 55, Mount Holly, N.J. 08060

[21] Appl. No.: 348,578

[22] Filed: Dec. 2, 1994

[51] Int. Cl.[6] ..... B65D 30/08; B65D 33/14

[52] U.S. Cl. ..... 383/24; 383/41; 383/111

[58] Field of Search ..... 383/24, 111, 41

[56] References Cited

U.S. PATENT DOCUMENTS

| | | | |
|---|---|---|---|
| 4,390,051 | 6/1983 | Cuthbertson | 383/111 |
| 4,781,472 | 11/1988 | LaFluer et al. | 383/105 X |
| 4,874,258 | 10/1989 | Marino | 383/111 |
| 4,946,291 | 8/1990 | Schnaars | 383/41 X |
| 5,192,134 | 3/1993 | Polett | 383/24 |

FOREIGN PATENT DOCUMENTS

| | | | |
|---|---|---|---|
| 0338181 | 10/1989 | European Pat. Off. | 383/24 |

*Primary Examiner*—Jes F. Pascua

*Attorney, Agent, or Firm*—Norman E. Lehrer; Jeffrey S. Ginsberg

[57] ABSTRACT

A flexible bulk container for the handling and storing of flowable or powdered bulk materials is provided which includes a flexible and collapsible bulk bag component and a disposable liner. The bulk bag component has an encircling side wall, a bottom wall with an opening therethrough and an open top end. A lifting loop is attached to each corner of the bulk bag component near the top end thereof. The disposable liner has a lower wall, a surrounding side wall and an upper wall. A portion of the upper wall of the liner extends laterally beyond the periphery of the surrounding side wall of the liner. The upper wall of the liner has four openings formed therein. Each of the lifting loops passes through a different one of the spaced openings in the upper wall of the liner for removably connecting the same to the bulk bag component.

7 Claims, 2 Drawing Sheets

FLEXIBLE BULK CONTAINER WITH DISPOSABLE LINER

FIELD OF THE INVENTION

The present invention relates to a flexible bulk container and, more particularly, to a flexible bulk container with a disposable liner releasably secured therein so that the liner can be easily disposed of after material has been discharged from the container.

BACKGROUND OF THE INVENTION

Large flexible fabric bags for containing and transporting flowable granular or powdered bulk material such as chemicals, minerals, foodstuffs, agricultural products, pharmaceutical and cosmetic ingredients and the like have been used for many years and their use is becoming increasingly more popular. This is due to their relatively low cost and the fact that when the bags are empty, they take up very little space and are relatively light in weight. When filled, the flexible bulk containers may carry a cubic meter or more of material and may weigh in excess of two tons.

The bags used for such purposes have to fulfill several practical requirements. It is necessary for the bags to be able to sustain heavy loads and, at the same time, be readily foldable or collapsible to a compact and relatively flat form when emptied. It is also important that such bags be designed so that, when filled, they can be easily handled, and are generally free standing and capable of being stacked vertically one upon another. Furthermore, depending upon the type of material being shipped, some fabric bulk bags may be required to be moisture proof, water resistant and/or hygienic, or requirements may be such that the contents must be sealed for the purpose of purity, in which case a polyethylene or the like liner is provided.

A variety of bags and bag constructions have been suggested and used as flexible bulk containers such as disclosed, for example, in U.S. Pat. Nos. 3,961,655; 4,113,146; 4,730,942; 4,781,472; 4,822,179; 4,909,410 and European patent publication No. 338,181. Although these bags and containers are common in the industry, there are several shortcomings which have been encountered and warrant further attention. For example, while the design, flexibility and light weight of many such bags renders them readily collapsible for convenient return by the user to the shipper for reuse, during the handling and storing of the bags they frequently come in contact with contaminants such as dirt, grease and the like which are deposited on or within the bags. This is particularly undesirable when the bag is filled with a foodstuff or pharmaceutical ingredient since protection from contamination is essential. Because fabric bulk containers in common use cannot be readily cleaned, disposal of the fabric bag is generally necessary when filling the same with materials that must be kept hygienically pure.

Some known bulk bags utilize a polyethylene or the like liner to contain particulate or granular material whereby the liner is insertable into the exterior fabric bag and the bag is formed with an opening or a spout at one end for discharging the contents. A common problem with such bags is the tendency for the particulate contents, when discharged, to draw the liner out of the bag. If the liner is not secured within the bag, the result is often that the liner itself will drop from the bag into the receiving container or bin and this could contaminate the contents which would be undesirable. It is, thus, common practice to secure the liner within the, bag, using techniques such as disclosed, for example, in U.S. Pat. Nos. 4,781,472, 4,874,258 and 4,946,241. However, due to the size of both the bags and liners, such known means for securing the liner within the bag are generally inconvenient and difficult to use.

Moreover, during the filling of such bags with a product, a great deal of dust can be generated which settles on exposed portions of the bag and liner, and as indicated, during the handling and storage of the bags, they frequently come in contact with contaminants such as dirt, grease, oil and the like against which the contents must be protected. In U.S. Pat. No. 4,909,410 there is suggested a bulk container with a removable protective cover for the outer surfaces of the container in the form of a skirt which is integrally secured to seams of the container. Such protective cover is removed from the bulk container to eliminate contaminants that may have been deposited on the external surface thereof but once removed, the container would have to be reconstructed for replacement of the protective cover and there is no other suggestion therein for cleaning the container itself for possible reuse.

Other devices such as removable covers have also been suggested for use with small hand-carried shopping bags and the like to protect the contents thereof against dirt and the elements. See, for example, U.S. Pat. Nos. 3,349,992 and 4,930,903. The shopping bags and the like containers employing such protective covers are substantially different in construction and use than the large bulk containers used for shipping and storage of bulk materials and the problems associated therewith are significantly different. Providing large, flexible bulk containers with a device which protects both the container surfaces and the contents thereof from being contaminated during filling, handling and storage would be particularly advantageous.

Applicant's prior patent, U.S. Pat. No. 5,192,134, discloses a flexible bulk container which can be thoroughly cleaned prior to use or reuse. This patent contemplates inserting a liner in between non-disposable top and bottom bulk bag components. The liner includes connecting means for connecting the liner within the top bag component. Replacing the liner after use requires that the top bulk bag component must be disconnected from the liner before the liner can be taken out of the container.

SUMMARY OF THE INVENTION

It is accordingly an object of the present invention to provide a flexible bulk container with a disposable liner releasably secured therein so as to present a container suitable for the handling and storing of flowable granular or powdered bulk materials which must maintain absolute purity and freedom from contamination.

It is a further object of the invention to provide such a container with a liner that can easily be removed and replaced.

In accordance with the present invention there is provided a flexible bulk container comprising a flexible and collapsible bulk bag component having a bottom wall, an encircling side wall and an open top end. The bottom wall has a discharge spout through which contents are discharged. Four lifting loops are secured to an upper portion of the side wall. The loops extend upwardly from the side wall above the top end of the bulk bag component. A disposable liner is receivable in the bulk bag component. The liner has a lower wall, a surrounding side wall and an upper wall. A portion of the upper wall of the liner laterally projects beyond the periphery of the surrounding side wall and has four openings formed therein. Each of the lifting loops is adapted to pass through a different one of the openings in order to connect the liner to the bag.

Other objects, features and advantages will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
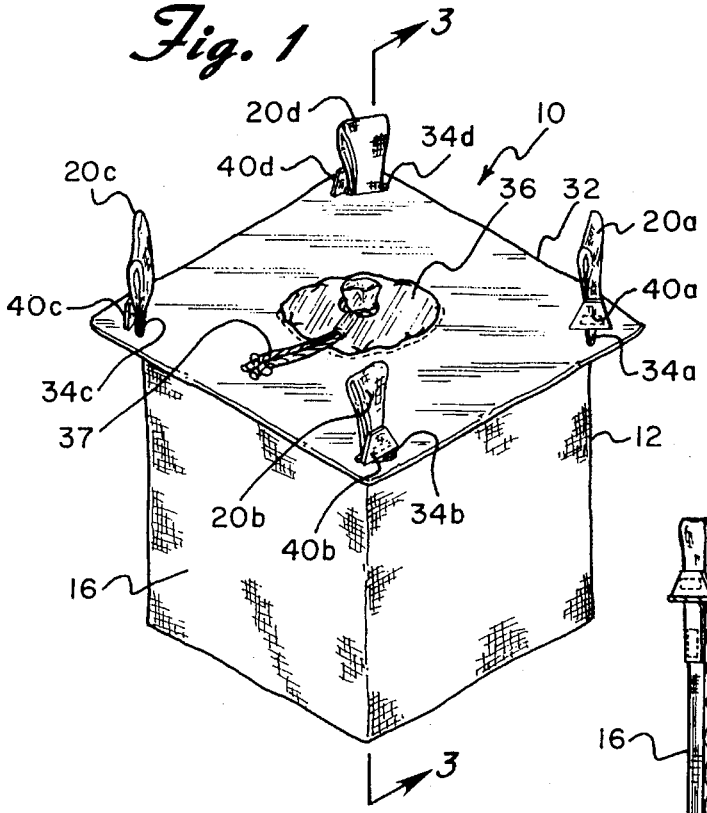
FIG. 1 is a top perspective view of a flexible bulk container constructed in accordance with the principles of the present invention.

Referring now to the drawings in detail wherein, throughout the various figures, like reference numerals identify like elements there is shown, in FIGS. 1 to 6, a flexible bulk container or bag constructed in accordance with the principles of the present invention and designated generally as 10.

The container 10 is of flexible, collapsible construction and includes a bulk bag component 12 and a disposable liner 26 receivable in said bag component in the manner described below. The container 10, when filled, is generally cubical in shape, as shown in FIGS. 1 to 6, and can be collapsed and folded into a generally flat and compact configuration.

Figure 3:
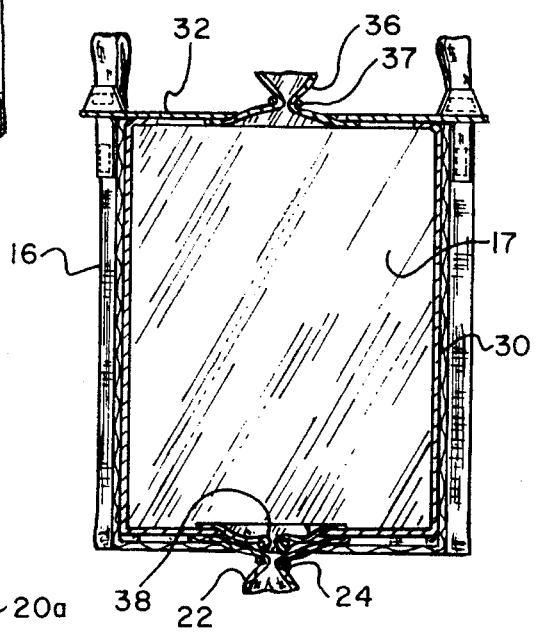
FIG. 3 is a cross-sectional view taken through the lines 3—3 of FIG. 1.
Figure 2:
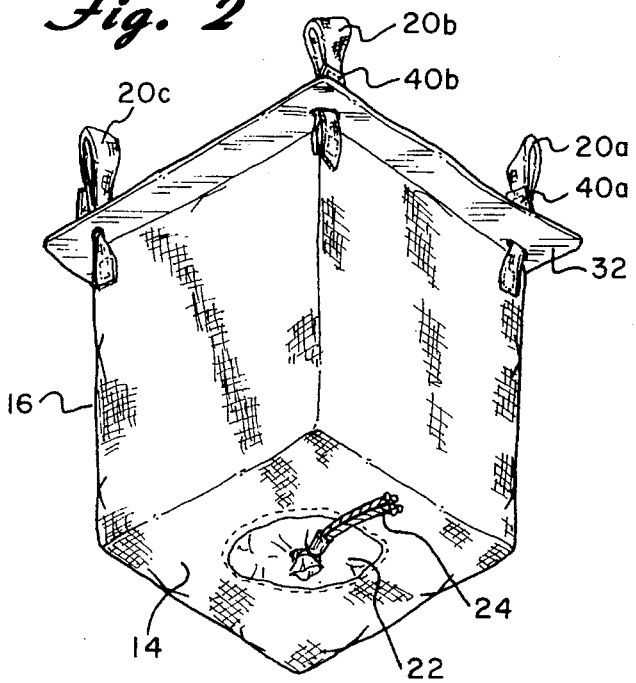
FIG. 2 is a bottom perspective view of the flexible bulk container shown in FIG. 1.
Figure 4:
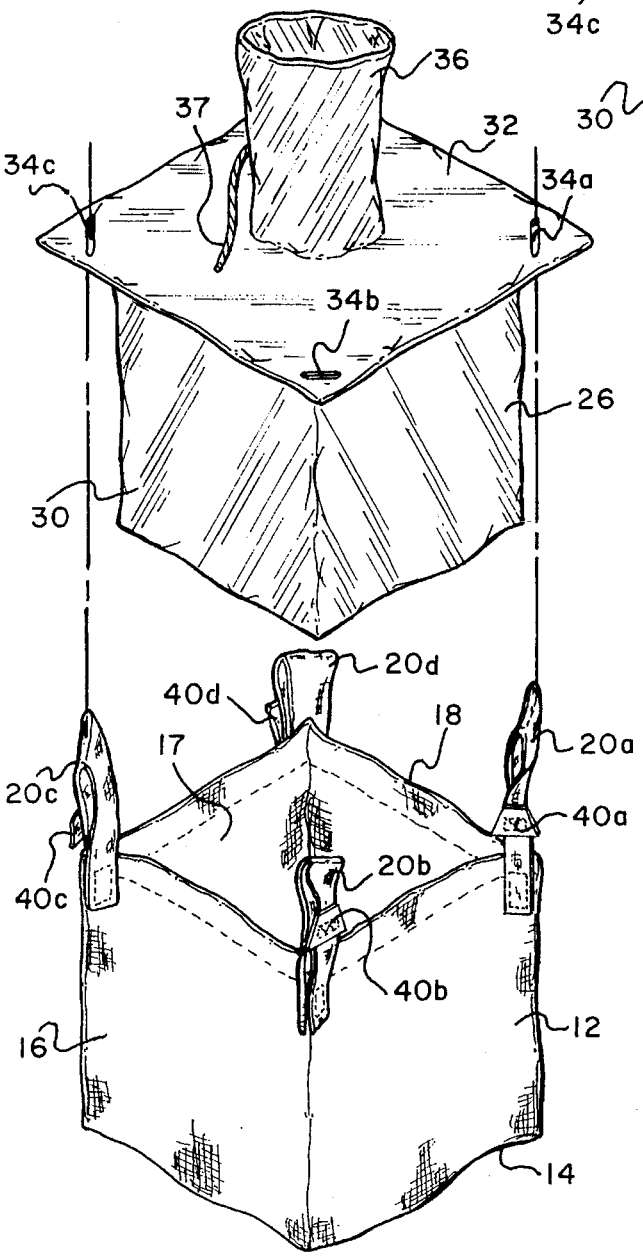
FIG. 4 is an exploded view, in perspective, of the flexible bulk container shown in FIG. 1.

The bulk bag component has a bottom wall 14, an encircling side wall 16 and an open top end 18. Four spaced apart lifting loops 20*a–d* are secured to the upper portion of the side wall 16 of the bag component 12. The lifting loops 20*a–d* project upwardly from the side wall 16 above the top end 18 as best shown in FIG. 4. The lifting loops are preferably secured to the bulk bag component 12 by stitching the loops at points adjacent the corners of the bag component in the manner well known in the art. The bottom wall 14 of the bulk bag component 12 has a closable discharge spout 22 for emptying the contents of the bag (see FIGS. 2 and 3). The discharge spout 22 can be of any conventional construction and can be closed in any well known manner such as by closing tie 24.

As stated above, the disposable liner 26 is receivable in the bulk bag component 12. The disposable liner 26 has a lower wall 28, a surrounding side wall 30 and an upper wall 32. A portion of the upper wall 32 of the liner projects laterally beyond the periphery of the surrounding side wall 30 and has four slot shaped openings 34*a–d* formed therein adjacent the four corners thereof. The upper wall 32 includes a collapsible fill spout 36 centrally located thereon. The fill spout can be of any conventional construction and can be closed by any known means such as by tie 37 as shown in FIGS. 1 and 3. The lower wall 28 of the liner 26 has a release spout 38 sized to fit in and extend through the discharge spout 22 in the bottom wall 14 of the bulk bag component 12 (see FIG. 3). It should be noted that, instead of having a spout, the lower wall can have an opening formed therein through which material can pass or can be continuous and severed when it is desired to release its contents.

The construction and arrangement of the bulk bag component 12 is essentially complementary to that of the disposable liner 26. The surrounding side wall 30 of the disposable liner is readily insertable within the encircling side wall 16 of the bulk bag component with the upper wall 32 of the liner being disposed at and over the top end 18 of the bulk bag component.

Each of the lifting loops 20*a–d* passes through a corresponding opening 34*a–d* formed in the upper wall 32 of the liner 26 for removably connecting the same to the bulk bag component. The side walls 16 and 30, the upper wall 32 and the bottom and lower walls 14 and 28, respectively, define, when assembled, an interior storage space 17 therebetween for storage of flowable granular or powdered bulk material. The surrounding side wall 30 of the disposable liner 26 is generally complementary to the encircling side wall 16 of the bulk bag component 12 so that when the container 10 is at least partially filled, the side wall 30 of the liner 26 is forced into engagement with and supported by the encircling side wall 16 of the bulk bag component 12.

In the preferred embodiment, each of the lifting loops 20*a–d* has a locking means in the form of a tapered flange 40*a–d*, with upwardly converging side walls, secured thereto. Each flange 40*a–d* is designed to fit through a corresponding opening 34*a–d* formed in the upper wall 32 of the disposable liner 26. The flanges 40*a–d* act like flexible barbs to fasten the disposable liner 26 to the bulk bag component 12 by creating an interference fit in the manner described below.

The bulk bag component 12 and the disposable liner 26 can be constructed of any suitable strong flexible material. For the bag component 12, natural or synthetic woven material can be employed such as jute cotton, polyethylene or polypropylene with woven polypropylene being typically used because of its strength, durability and puncture resistance. The liner 26 is preferably made from polyethylene and the upper wall 32 may have reinforcing fibers therein to increase its strength.

To facilitate an understanding of the principles of the foregoing apparatus, its operation will now be briefly described. The liner 26 is first inserted into the bulk bag component 12 when the two components are being assembled to form the container 10. The liner is removably connected to the bulk bag component by threading the lifting loops 20*a–d* and attached flanges 40*a–d* through openings 34*a–d* formed in the upper wall 32 of the liner 26. This can be conveniently accomplished since the top end 18 of the bag component 12 is open and readily accessible for receipt of the liner within the bulk bag component by manual manipulation of the liner and the bag component.

Figure 6:
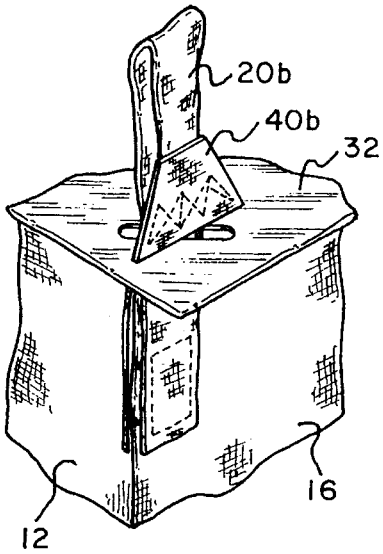
FIG. 6 is an enlarged top perspective of a lifting loop secured in the disposable liner.

In order to secure the liner and bag component to one another, the lifting loops are slightly rotated so that the bottom portion of flanges 40*a–d* traverse the openings 34*a–d* and separation is thereby hindered (See, for example, flange 40*b* in FIG. 6). The lifting loops provide means for supporting the container 10 for filling and for readily transporting the container 10 when filled with material.

Figure 5:
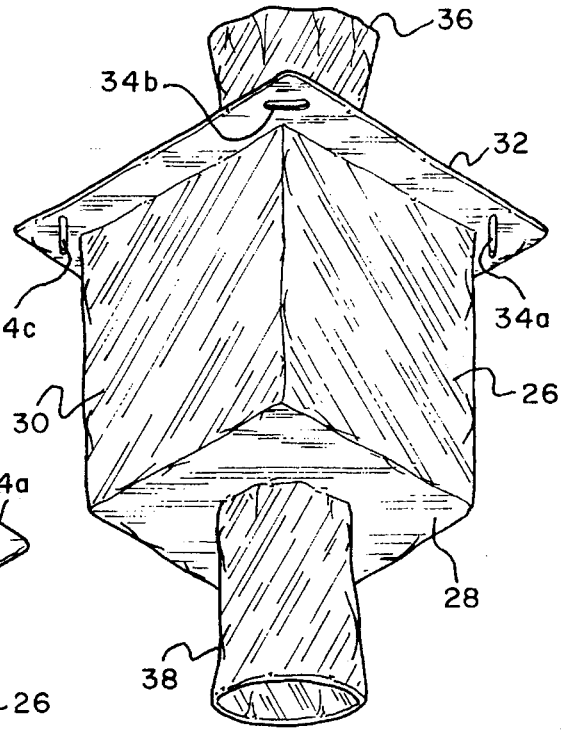
FIG. 5 is a bottom perspective view of the disposable liner.

The release spout 38, which is centrally located in the lower wall 28 of the liner, is aligned atop the discharge spout in the bottom wall 14 of the bulk bag component. When the liner and bag component are secured to one another in the manner described above, tie 37 is freed and the fill spout 36 is manually adjusted so as to extend upwardly from the upper wall 32 of the liner 26 as illustrated in FIGS. 4 and 5. The container is now ready to receive the fill material.

After the container 10 is filled, it can be readily transported to the required destination. When the material is to be released from the bag, tie 24 is freed and discharge spout 22 is adjusted to extend downwardly from the bottom wall 14 of the bag component. The weight of the material in the container forces the release spout 38 in the liner to extend downwardly into the discharge spout 22 and the material can then be emptied from the container.

The use of the liner protects against contamination by dust, dirt, oil and the like on the interior of the bag component. After the container has been emptied, the liner can be readily removed from the bag and disposed of. This can be accomplished by aligning the bottom of the flanges 40*a–d* with the openings 34*a–d* in the upper wall 32 of the liner 26 so that the lifting loops 20*a–d* can be disengaged from the liner. The liner 26 can then be manually removed from the bag component 12. A clean disposable liner can then be reinserted into the bag component in the manner described above.

Having thus described the invention in relation to the drawings hereof, it will be clear that modifications could be made to the preferred embodiment without departing from the spirit of the invention. Accordingly, it is not intended that the words used to describe the invention be limiting thereof nor should the drawings be considered so. It is intended that the invention be limited only by the scope of the appended claims.

What is claimed is:

1. A flexible bulk container for handling and storing flowable materials comprising in combination:

a flexible and collapsible bulk bag component having a bottom wall, an encircling side wall and an open top end, said encircling side wall having at least two lifting means secured to an upper portion of said wall and extending above said top end;

a disposable liner means receivable in said bulk bag component, said liner means having a lower wall, a surrounding side wall and an upper wall, said upper wall having at least two openings formed therein, and a locking means carried by each of said lifting means, each of said lifting means and its associated locking means passing through a different one of said openings in said upper wall of said liner means to create an interference fit therebetween to releasably fasten said liner means to said bulk bag component.

2. The flexible bulk container of claim 1 wherein said locking means are flexible barbs.

3. A flexible bulk container for handling and storing flowable materials comprising in combination:

a flexible and collapsible bulk bag component having a bottom wall, an encircling side wall and an open top end opposite said bottom wall, said bottom wall being connected to a lower portion of said side wall and having a discharge spout therethrough, said encircling side wall having at least two lifting means secured to an upper portion of said encircling side wall and projecting upwardly therefrom above said top end, said bottom wall and said side wall defining an interior storage space therebetween for the flowable materials;

a disposable liner means receivable in said bulk bag component, said liner means having a lower wall, a surrounding side wall and an upper wall, said upper wall of said liner means having a portion projecting laterally beyond the periphery of said surrounding side wall, said portion of said upper wall having at least two openings formed therein, said upper wall having a receiving port extending upwardly therefrom, said liner means being of a size generally complementary to the storage space defined by said bulk bag component, and a locking means carried by each of said lifting means, each of said lifting means and its associated locking means passing through a different one of said openings in said portion of said liner means to create an interference fit therebetween to releasably fasten said liner means to said bulk bag component.

4. A flexible bulk container for handling and storing flowable material comprising in combination:

a flexible and collapsible bulk bag component having a bottom wall, an encircling side wall and an open top end, said encircling side wall having at least two lifting means secured to an upper portion of said side wall and extending above said top end;

a disposable liner means receivable in said bulk bag component, said liner means having a lower wall, a surrounding side wall and an upper wall, said upper wall of said liner means having a portion extending laterally beyond the periphery of said surrounding side wall of said liner means, said portion of said liner means having at least two openings formed therethrough, and a flexible barb secured to each of said lifting means, each of said lifting means and its associated barb passing through a different one of said openings in said portion of said liner means to releasably fasten said liner means to said bulk bag component.

5. The flexible bulk container of claim 4 wherein said encircling side wall of said bulk bag component has four corners.

6. The flexible bulk container of claim 5 wherein said lifting means includes four lifting loops and said portion of said liner means has four openings formed therethrough, said bulk container further including four flexible barbs, each of said lifting loops being secured to a different corner on said bulk bag component, each of said lifting loops passing through a different one of said openings, each of said flexible barbs passing through a corresponding one of said openings in said portion of said liner means to releasably fasten said liner means to said bulk bag component.

7. The flexible bulk container of claim 6 wherein said bottom wall of said bulk bag component has a discharge spout formed therein and said lower wall of said liner means has a release spout formed therein, said release spout of said liner means being sized to fit in and extend through said discharge spout in said bottom wall of said bulk bag component.

* * * * *